United States Patent [19]

Marazzi

[11] 4,009,993

[45] Mar. 1, 1977

[54] AUTOMATIC PLANT FOR THE DRYING AND FAST SINGLE-PHASE FIRING OF CERAMIC TILES

[76] Inventor: Pietro Marazzi, V.le Giacobazzi 3, Sassuolo (Modena), Italy, 41049

[22] Filed: June 20, 1975

[21] Appl. No.: 588,812

[30] Foreign Application Priority Data

July 2, 1974 Italy ..... 24711/74

[52] U.S. Cl. ..... 432/122; 432/144; 432/236; 432/246

[51] Int. Cl.[2] ..... F27B 9/14; F27D 3/00

[58] Field of Search ..... 432/130, 144, 146, 236, 432/246, 122

[56] References Cited

UNITED STATES PATENTS

| | | | |
|---|---|---|---|
| 1,988,837 | 1/1935 | Dressler | 432/146 |
| 3,102,720 | 9/1963 | Tinker | 432/144 |
| 3,123,344 | 3/1964 | Ross | 432/122 |
| 3,338,569 | 8/1967 | Cuvelier | 432/246 |
| 3,489,397 | 1/1970 | Alexander | 432/246 |
| 3,867,748 | 2/1975 | Miller | 432/246 |
| 3,947,242 | 3/1976 | McMaster et al. | 432/122 |

FOREIGN PATENTS OR APPLICATIONS

| | | | |
|---|---|---|---|
| 230,756 | 3/1925 | United Kingdom | 432/146 |

*Primary Examiner*—John J. Gamby
*Attorney, Agent, or Firm*—McGlew and Tuttle

[57] ABSTRACT

The present invention regards an automatic plant to perform continuously and with high yields on an industrial scale, the drying and single-phase firing operations on ceramic tiles used for wall-lining and floor-lining, which comprises an assembly of the type commonly called "tunnel kiln", along the length of which the semifinished products to be treated travel, and is associated with suitable heat sources, so as to establish in the environment defined by the tunnel or gallery of the kiln, the thermal conditions necessary for the development and completion of firing of the tile body as well as of the surface layer of the glaze.

11 Claims, 14 Drawing Figures

AUTOMATIC PLANT FOR THE DRYING AND FAST SINGLE-PHASE FIRING OF CERAMIC TILES

BACKGROUND OF THE INVENTION a. The Field of the Invention

The present invention regards an automatic plant to perform continuously and with high yields on an industrial scale, the drying and single-phase firing operations on ceramic tiles used for wall-lining and floor-lining. By the term "single-phase firing" it is meant a process already known, by means of which the semifinished products comprising planar bodies of suitable composition pressed to their final geometrical and flatted shape, covered on one of their faces with a suitable glazing composition or glaze, are heat treated, so as to proceed in a single step to the firing as well as ceramic becoming of the composition of the tile body and glazing of the surface layer of the glaze.

The improved plant according to the invention particularly comprises an assembly of the type commonly called tunnel kiln, along the length of which the semi-finished products to be treated travel, and is associated with suitable heat sources, so as to establish, in the environment defined by the tunnel or gallery of the kiln, the thermal conditions necessary for the development and completion of firing of the tile body as well as of the surface layer of the glaze.

b. The Prior Art

The technology of the production of these ceramic tiles, as well as operation of the tunnel-kilns for firing of same, is well known in the art and does not require any further explanation.

BRIEF SUMMARY OF THE INVENTION

The improved plant according to the invention is particularly suitable to carry out the whole process of firing the tile body and the glazed or vitrified surface by a single pass through the tunnel kiln and in a condition of complete exposure of the material to radiation and the overheated atmosphere inside the tunnel, so that the heat exchanges take place at a speed sufficient to enable to carry out and complete the process in an extremely short time, for example of the order of 30 minutes. Further, the improved plant according to the invention is characterized in that it comprises means, technical solutions and particular associations of such means and such solutions to permit advancing of the material under treatment, at a high linear speed, with an obvious high yields on an industrial scale. The improved plant according to the invention is further characterized by the capacity to carry out with strict evenness the treatment of the semi-finished products proceeding along the kiln tunnel so as to make full use of the width available. The attainment of these important industrial results presupposes, in general, the following specific conditions, which are so coordinated that they result in quick, even and efficient heat exchanges necessary to ensure a fast transformation of the raw material into the desired finished product.

The essential technical solutions which individually or in combination contribute in obtaining the advantageous results according to the invention, will readily appear from the following detailed description of a preferred example of actuation of same, given without limitation, with reference to the accompanying drawings.

DETAILED DESCRIPTION OF PREFERRED EMBODIMENTS

Figure 1A:
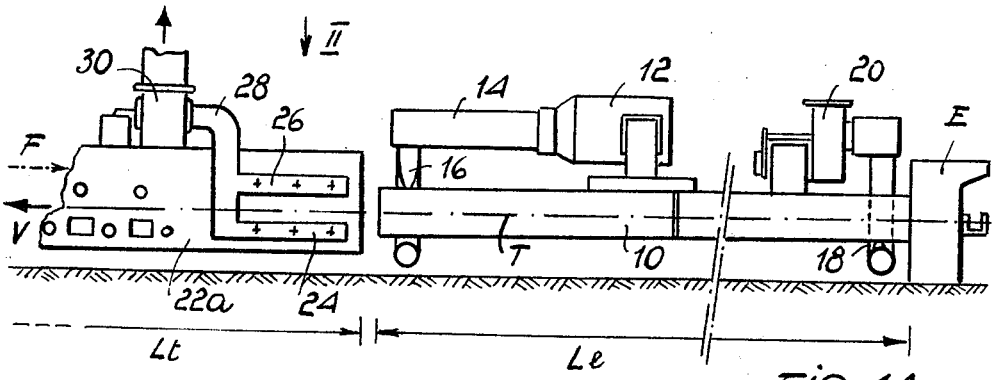
FIGS. 1*a*, 1*b*, and 1*c* are side views, which are schematic being made to a reduced scale, of the main parts of the improved plant assembly, these parts being considered already joined and aligned in succession, in order to form the complete plant.
Figure 1B:
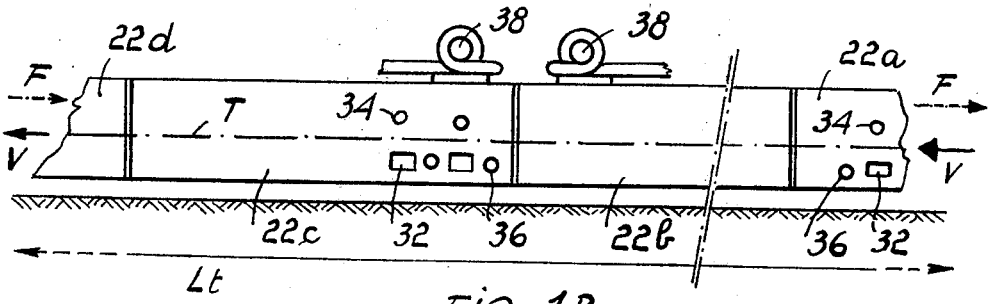
Figure 1C:
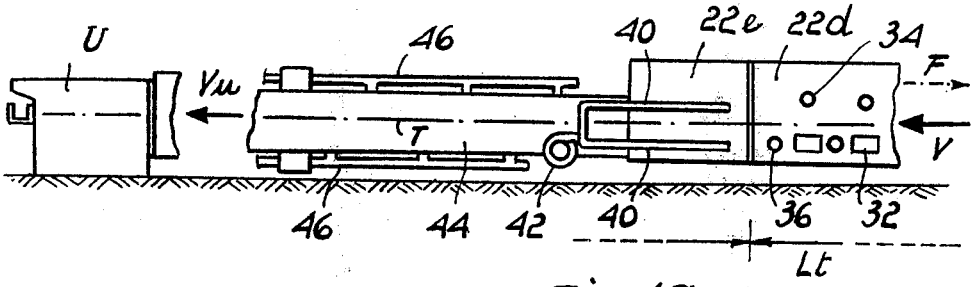
Figure 2:
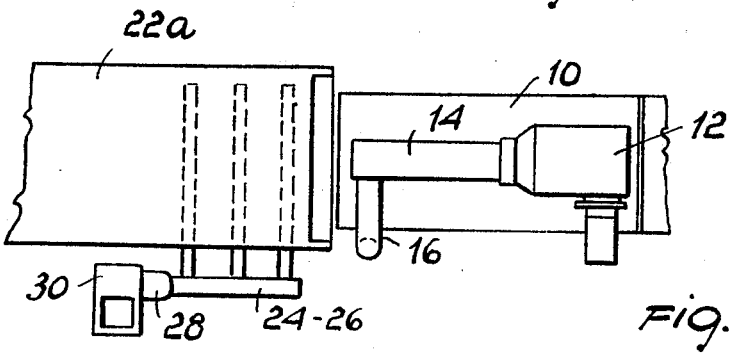
FIG. 2 is a fragmentary view of a length of the initial portion of the plant, seen from the top along the line indicated II in FIG. 1.

The complete improved plant may be seen with reference to FIGS. 1*a*, 1*b*, 1*c* and 2.

In these drawings it may be seen how such an assembly comprises mainly a system of associated and aligned devices such as to jointly define, with the means described hereinafter, the whole path of the materials to be treated, from an input unit E to an outlet unit U. This path is contained in a horizontal plane, the outline of which in both directions, is indicated by the chain line T.

By following the feeding direction of the material, along path T, the plant comprises a first device, indicated as a whole at 10, which forms the drying unit or assembly for the glaze applied into the semi-finished products, by means which will not be described as they are well known. This inlet device 10 comprises in addition to the means to support and feed the materials, corresponding to those hereinafter described with reference to the successive parts of the plant, also means to establish and maintain a hot and intense gaseous current, proceeding in a direction opposite to the feeding of the material, in order to ensure said drying. These means mainly comprise a heat generator of the direct type, such as a burner 12, which by means of a system of conduits 14, 16 feed the combustion products in the steady portion of the tunnel or gallery formed along device 10. These combustion gaseous products, which travel in counter current along said tunnel, with a swirling motion and duly ensured by suitable partitions, are then sucked and exhausted by means of a suction system 18, 20. The length Le of the drying device 10 is generally of the order of 10 m., and anyway is such that, considering the feeding speed V, the products issuing from said drying device have lost any moisture content they may have and are already at a suitable temperature to permit their immediate transfer in the actual firing unit, where they may immediately receive the application of heat at such conditions that the curve of temperature increase of the pieces of materials will be as steep as possible; however, without giving rise to break-ages or alterations in the materials.

The actual firing treatment assembly, having a length Lt for instance of the order of 30 m. and more, is divided, for structural reasons, as well as for a suitable selective differentiation between the treatment means and conditions, into a plurality of sections 22*a*, 22*b*, 22*c*, 22*d* and 22*e*. The last one of these sections practically coincides with the beginning of the final cooling device, which integrates the cooling due to the spontaneous heat dissipation by the fired tiles.

The heat sources are evenly and suitably distributed throughout the treatment length Lt. These sources, which are essentially well known, are formed by as many burners which feed into the cavity running longitudinally along the furnace, a flow of combustion gaseous products, suitably diluted in order to ensure that the are at the temperature required. This flow, which is constantly integrated by the introduction of the combustion products placed on the treatment length Lt, therefore travels along the tunnel furnace in direction F, opposite to the feeding direction of the material. Arranged facing the leading unit 22*a* of the actual furnace are means for suction and exhaust of the heating gaseous current. These means, according to an important feature of the improved plant, are such that the gaseous current is evenly sucked at the level of the entire cross-section of the tunnel or gallery. Particularly, as mentioned, suction systems 24 and 26 are provided below and respectively above the plane of path T of the advancing material, these systems being connected, by means of manifolds 28, to a suitable suction device 30.

Along the entire length Lt of the treatment equipment, closely and equally spaced apertures 32 are provided for access and inspection inside the tunnel. The availability of various access points, along this length, is very important particularly because it enables removal of eventual tile fragments which, during firing could have been broken, for any reason at all, or penetrate into the gaps between the various supporting and feeding rollers, as will be described hereinafter. Similarly, the heat sources are arranged throughout the treatment length Lt, their positions indicated at 34 and 36 being equally and closely spaced, above and respectively below said plane, the outline of which is indicated at T, along which the material travels during treatment. Said portion of the equipment is completed with the various means feeding the heat sources and auxiliary control means in addition to the various means to advance the materials, as will be described in the following. For example, in FIG. 1*b* some of the blowing means for the combustion air to the burners which form said heating sources are shown schematically and indicated at 38.

The trailing unit 22*e* of the treatment assembly preferably comprises means 40 for the distribution of the air supplied through a distributor or blower 42, automatically regulated for final thermal control of the treatment environment, and the start of the cooling process whit prefixed gradient in the first steps of the same. This cooling process is carried out in one or more units 44, arranged in a direct sequence in relation to the actual treatment furnace, and associated with the distributing means 46 for the cooling air, in the amount required to integrate the spontaneous heat loss from the fired articles continuously issuing from the treatment furnace.

Figure 3:
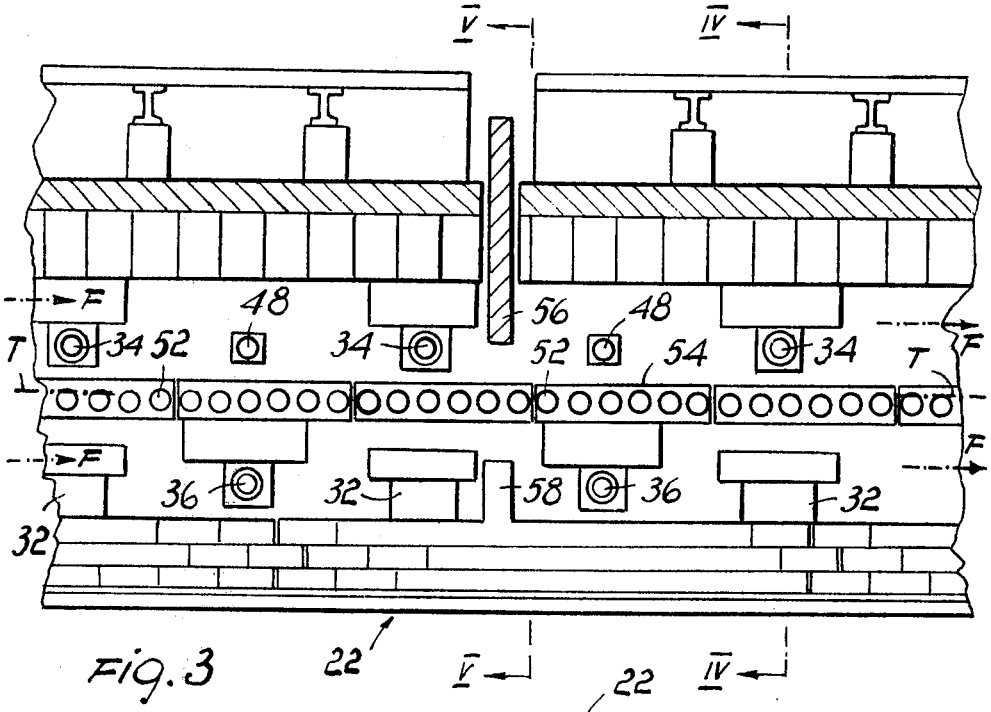
FIG. 3 is a sectional view on a longitudinal vertical plane of a length of the intermediate portion of the plant, showing certain essential technical features which are repeated substantially throughout the length of the tunnel kiln.
Figure 4:
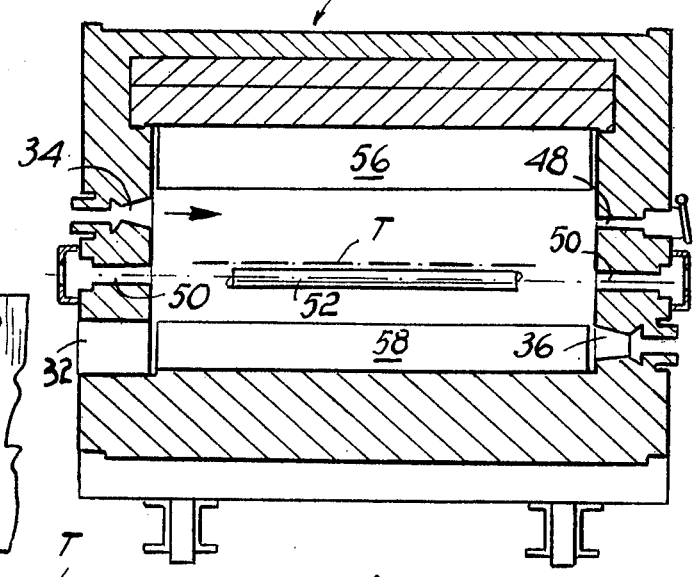
FIG. 4 is a cross section of same, taken along the plane and in direction indicated IV—IV in FIG. 3.
Figure 5:
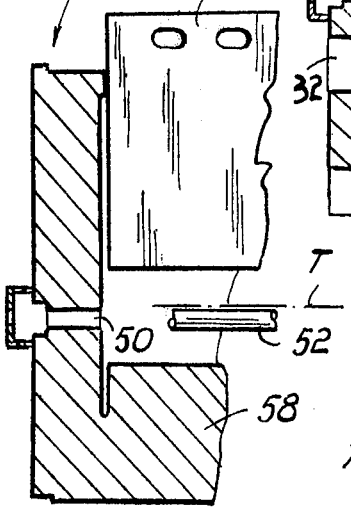
FIG. 5 is another fragmentary view of the portion shown in FIG. 3, taken along the plane indicated V—V in FIG. 3.

FIGS. 3, 4 and 5 are simplified and schematic views of the structure of the actual treatment assembly, such structure being substantially the same throughout the length of the assembly. In these drawings it may be seen how the apertures 34 and 36 for the heating sources, are alternatively arranged above and below the plane (indicated T) along which the tiles being fired travel. In FIG. 4 it may also be seen how these apertures are provided alternatively at the top and at the bottom, in the two sides of the insulating structure of the tunnel furnace. In these sides there are also other inspection holes 48, provided with suitable doors, for example for controlling the steady running of the heat sources facing the opposite wall.

In the same walls of the tunnel, are provided closely spaced holes 50 for the introduction of the ends of rollers 52 which support and advance the material. These rollers are suitably grouped in assemblies 54 (FIG. 3) to ease operation and control in limited groups for the reasons mentioned in the following.

The furnace also comprises suitably spaced partitions 56 and 58 which intercept a portion of the section of passage of the gaseous flow F which travels in countercurrent through the furnace. These means establish and maintain along the furnace a swirling condition which substantially helps to ensure strict evenness of the temperature throughout the whole section of such gaseous current. In such a way the uniformity of the heat treatment and regularity in the processes and transformations in the material advancing along the treatment chamber, is also ensured.

Said uniformity and evenness of treatment for each single tile fed into the furnace, as well as the high speed with which the desired phenomenon of firing and transformation of the material are obtained, that is the fast completion of the firing process, require that the transportation of the tiles being fired occurs with the maximum evenness and efficiency and also require that through the walls of the furnace no undue heat exchanges will take place, nor heat losses or exchanges with the environmental atmosphere. These advantageous feature of the improved plant according to the invention are obvious particularly from FIGS. 6 to 9.

Figure 6:
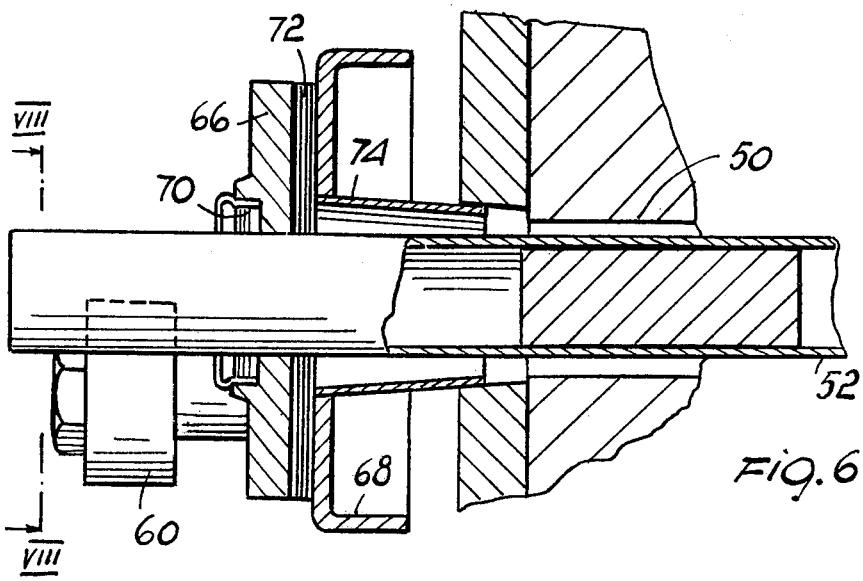
FIGS. 6 and 7 are sectional and partial views of the details of preferred technical solutions for the support, at both of their ends, of the rollers supporting and feeding the semi-finished products under treatment.
Figure 7:
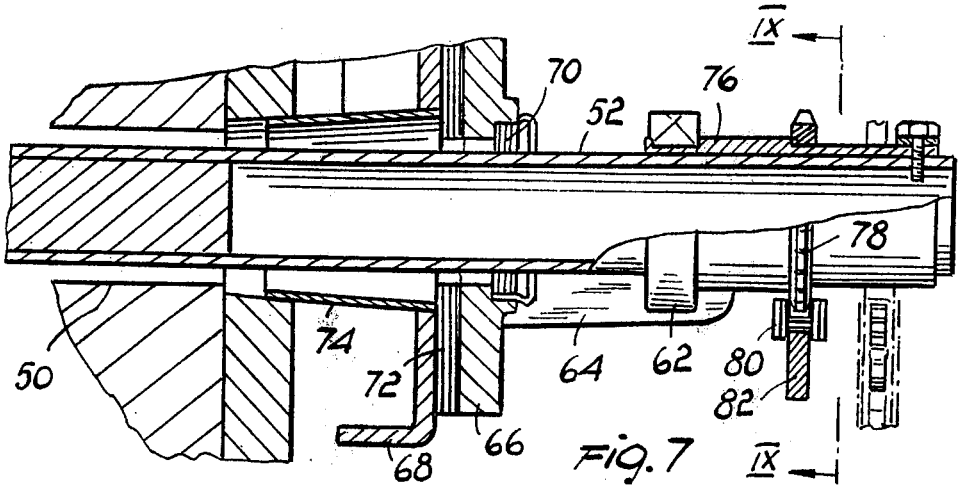

In FIGS. 6 and 7 it may be seen how rollers 52 for transportation of the material are supported at both ends, by means arranged outside the furnace and for this purpose such rollers pass through the relevant opposite walls of the furnace by means of said passages or holes 50. These rollers 52 are simply revolving supported on the left-hand side of the furnace, as shown in FIG. 6, and similarly supported but also driven on the right side of the furnace as shown in FIG. 7. At both sides these rollers are supported by means of parts associated to components 68 belonging to the metal structure of the furnace. These components comprise perforated plates 66, provided with labyrinth seal gaskets 70 and opposed to the metal components 68 by means of further gaskets 72 made of asbestos fibres or equivalent heat resisting means. Tubular sleeves 74 which extend between said sealing means and the wall of the furnace, complete closure of the actual furnace and prevent leakage of air or combustion gaseous products from outside to inside of the furnace and vice-versa.

On the side of simple rotating support of the rollers (FIGS. 6 and 8) these rollers are supported by resting saddled between adjacent pairs of freely revolving guide roller 60, supported by said plates 66. At least a portion of these guide roller is adjustable to correct alignment, parallelism and coplanarity of all the rollers jointly forming the feeding plane for the tiles. At the opposite side (FIGS. 7 and 9) the rollers 52 are supported by bearings 62 resting saddled between pairs of projections 64 fast with the adjacent plate 66. In this way the single rollers may be directly and easily withdrawn by slipping them off the furnace chamber for quick inspection and eventual replacement, even during operation of the furnace.

Each roller is mechanically actuated and receives a steady rotating motion. Driving of said rollers is carried out, particularly in groups of rollers such as groups 22*a* – 22*b* – 22*c* – 22*d* . . . of FIG. 1, by means of a suitable mechanical system. The distribution of mechanical actuation of the rollers in groups each including a limited number of rollers particularly permits that this actuation be selectively controlled, for instance, by means of photoelectric sensors or other suitable means in order to obtain control, for example through an electronic control system, of the speeds of rotation and therefore of the surface speeds of the rollers of each group. This control ensures that equal spacing is kept between proceeding tiles and permits, if necessary, correction of such spacing, by accelerating or delaying movement of the rollers in the various areas of the furnace.

This actuation in groups further permits to carry out auxiliary and complementary actions just in case, during feeding of the material, certain irregularities or peculiarities should occur. For instance, if at a particular point in the furnace certain overlappings or other jammings are noted, the electronic control device may signal these particularities or even handle them directly. Particularly, the groups of rollers arranged downstream of the point or area where the irregularity occurs, may be kept moving steadily so as to proceed and complete treatment of the materials not subject to such irregularities. In the area where the jammings occur, the rollers may be stopped in order to permit removal of the tile fragments or similar. At the upstream area, instead, the electronic control device may determine that actuation of the rollers continues, with a quick reciprocating motion, so as to avoid that the tiles present upstream, proceed further and reach the area where the jamming exists, however, in the meantime it is ensured that they do not dwell overlapping in a predetermined and constant position the rollers, which could lead to deformation of the rollers.

Figure 8:
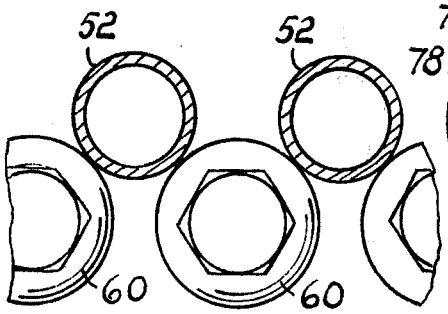
FIGS. 8 and 9 show further details of said means, seen from the planes in the direction indicated VIII—VIII and IX—IX, respectively, in FIGS. 6 and 7.
Figure 9:
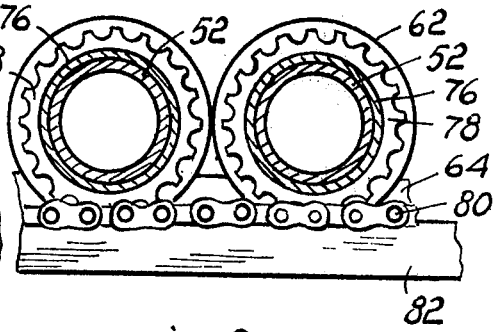

According to the preferred example of the mechanical actuation means shown in FIGS. 7 and 8, at the ends of each roller 52 is associated, for instance, by means of a sleeve 76, a sprocket wheel 78. Below the sprockets belonging to the same group of adjacent rollers, a drive chain 80 is arranged, the upper run or branch of said chain, transversally supported and guided by a bar 82 placed sideways, acts as a continuous rack, by thus alternating all wheels 78 and the respective rollers 52, as shown in detail in FIG. 9. This bar 82 is readily lowerable so as to obtain disengagement of the wheels 78 from the upper run of chain 80. This disengagement allows complete slipping off of the single rollers, as hereinbefore described, which are axially restrained only by engagement of the respective wheels 78 with the run of chain 80. When the necessary replacement of the operation indicating the irregularity has been made, and the roller or rollers have been replaced in their active position, lifting of bar 82 returns the whole device to the operating condition, by axially stabilizing the rollers thus engaged and driven.

A further important feature of the efficiency and steady operation of the furnace, at the desired even distribution of the heat rate as a function of the temperatures of the flows, that means of the conditions determing the running of the firing process, is due to the steady operation of the various heat sources, which are evenly and equally spaced on both sides of the firing chamber. These heat sources are formed by an equal number of burners, fed particularly with gaseous fuel. These burners have to critically satisfy certain service requirements. For example, they must be able to individually emit gaseous currents, formed by the gaseous combustion products, mixed with air in the exact amount required for these currents to establish inside the furnace an atmosphere at the precise temperature needed for firing, this temperature being generally comprised between 1050° and 1100° C, making close allowance to be determined in each single case depending on the specific composition used for the production of the tiles.

These burners also must be such as to permit gradual running of the furnace, that is, gradual heating thereof, without fear of interruption of the flame and with a well balanced transition from initial running at a low temperature, to final running at the operating temperature. It being obvious that the flame produced by the reaction between the fuel and combustion air always has a very high temperature, generally of the order of 1400° C, the adjustment of the gaseous current temperature fed in the furnace may be effected exclusively by the introduction of diluent atmospheric air. In order to be able to introduce flows at a fairly low temperature, at the start when heating the furnace, it may be necessary that the amount of said diluent air be many times higher — up to 8 or 10 times — the amount of stoichiometric air needed to support the flame, in relation of the amount of gaseous fuel introduced.

Figure 10:
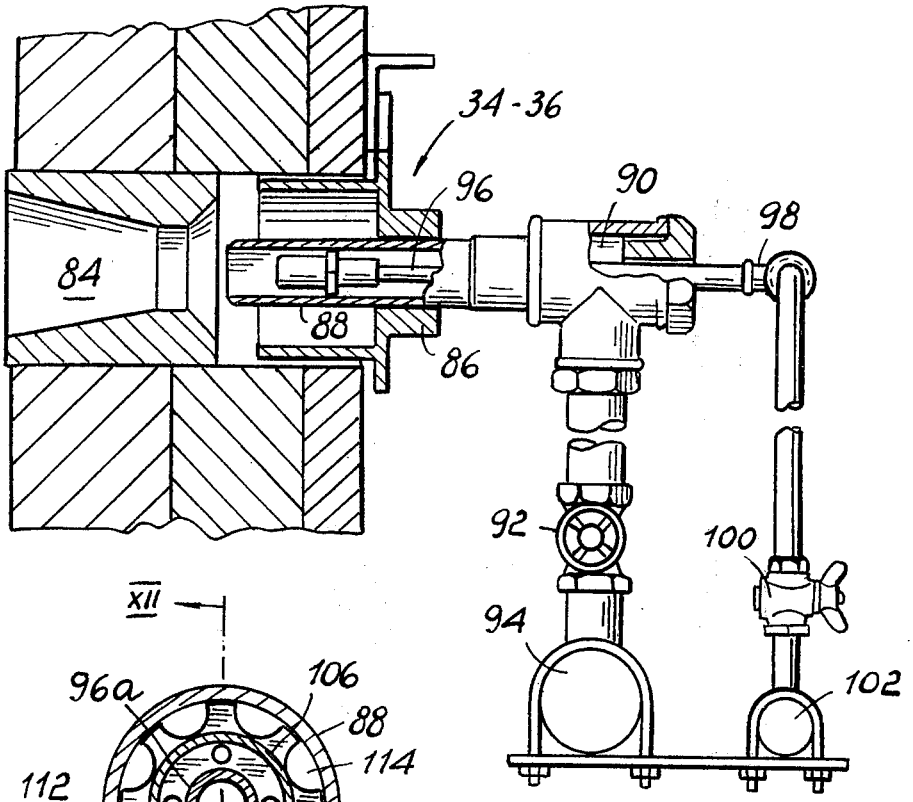
FIG. 10 is a sectional and partial view to a reduced scale, of any one of the various means forming the heat sources, associated with the improved plant.
Figure 11:
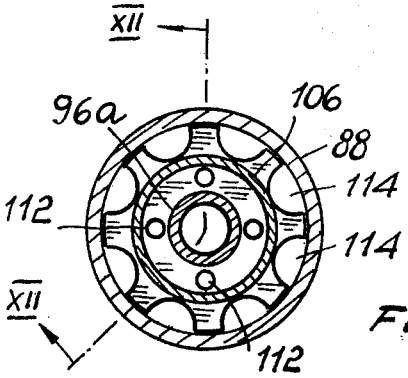
FIG. 11 shows to a larger scale, one of the details of said means, obtained by sectioning the same along the plane indicated XI—XI in FIG. 12.
Figure 12:
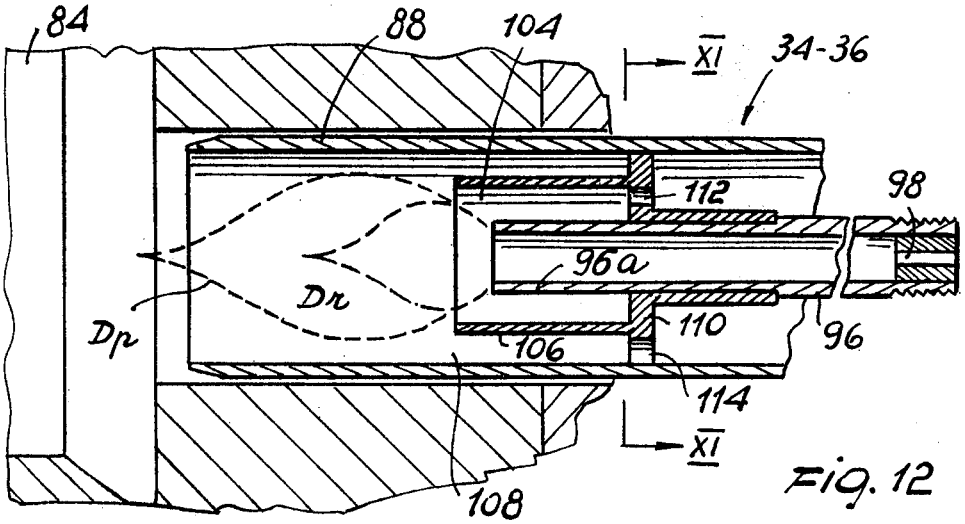
FIG. 12 shows the same detail, in section, in the diametral plane indicated XII—XII in FIG. 11.

FIGS. 10, 11 and 12 show a preferred example of these burners, which present, in combination the advantageous feature of a high and steady efficiency at the various heat rates, as well as a great simplicity of structure, maintenance and service, respectively.

Each of said burners is placed axially facing a respective passage 84 having a converging/diverging double cone, arranged in the furnace wall. This passage has a section and a length such as to ensure that upon entry of the gaseous hot current in the furnace chamber, this current is substantially homegeneous and has a favourable swirling motion.

Each burner is supported and positioned by a port-stopper 86 and comprises concentric tubular bodies forming conduits for feeding combustion air and combustible gas. The entire assembly of the burner and its driving, control and feeding accessories is shown in FIG. 10. This burner comprises an inner tube 88 which defines outside the port-stopper 86, in the cavity 90 of a D-connector in which ends by means of a register and an onn-off valve 92, the conduit feeding combustion air, drawn from a main conduit 94 feeding a plurality of burners. Inside and coaxially to tube 88 a second smaller tube 96 is provided for feeding of combustible gas. This smaller tube completely crosses the horizontal length of the T-connector and joins at 98 a pipe including a stopcock or an "on-off" valve 100, branching off the fuel from a main pipe 102.

As may be see, in FIG. 12 the outer end of inner tube 96 includes a calibrated nozzle 98 so that the flow rate of combustible gas may be predetermined depending on the pressure applied to the main pipe 102. As shown in detail in FIGS. 11 and 12, the outlet or inner end 96*a* of the inner tube 96 is encircled by a short tubular sleeve 106 which forms a first inner cylindrical air gap 104 between same and said end 96*a* and a second inner air gap 108 between same and the outer tube 88. The front end of sleeve 106 is substatially retracted in relation to the end of outer tube 88 and the front end of inner portion 96*a*, that means of the tube feeding an exhausting the combustible gas, is also retracted with respect to the front end of sleeve 106. This sleeve is supported in the desired position by a diaphragm 110 which intercepts the annular space between the outer tube 88 and the inner tube 96. As may be seen particularly from FIG. 11, this diaphragm 110 presents a plurality of passages 112 having relatively small sections, which place in communication the space inside the outer tube 88, reached by the combustion air, with the inner air gap 104 and another set of passages having a larger section and formed, for instance, by recesses 114 which place in communication said space inside tube 88 with the outer airgap 108.

Now, supposing the furnace has to be started and gradually run to its full power. In this case the burners are started with a small amount of combustible gas, enough to form a small flame or "dart" Dr (see FIG. 12) at the end of tube 96. This small flame is fed by the combustible gas emitted at the centre of same through tube 96 and the air entering airgap 104 through passages 112. The air wich passes through airgap 108, goes inside the small flame Dr without affecting it, particularly without extinguishing it, and dilutes to a great extent the flow of combustion products present opposite said small flame Dr. In such a way, low temperature gaseous flows are introduced in the furnace in the amount needed for gradual rise of the temperature in the whole structure of the furnace. By progressively increasing the flow rate of gaseous fuel, through the inner tube 96, the small flame progressively expands until it reaches the dimensions of a full power rating flame Dp.

During the course of its progressive expansion, this flame Dr gradually intercepts, in turn, the outer annular current of the combustion air which comes out through the outer airgap 108. This outer flow, is therefore progressively transformed from simple flow of diluent air, into a secondary air flow which participates to the combustion and completes it. In general, since the temperature of the entire gaseous flow to be introduced into the furnace chamber has to be lower than the one which, due to combustion, develops in the dart of small flame, these passages and feeding of the air and gas are adjusted so that there is always an excess of air with respect to the primary and secondary air necessary to complete combustion, so that such an effect forms a diluting air adjusting the final temperature of the gaseous current.

It has been found that a simple structure, similar to the one shown in FIGS. 11 and 12 ensures the most ample variation in the rate and temperature of the entire flow without giving rise to blowing-out or unevennes in the flame, by going from dilution air ratios which may be of the order of 2,000 percent of the combustion air used to form the reduced flame Dr, up to values close to those stoichiometrically needed for combustion. Further, this gradual transition from a very reduced rate to the full power rate of the burner, may tale place gradually and since this transition is due to the flow rate of gaseous fuel, it may be effected with the maximum uniformity in all the furnace burners, by progressively increasing the pressure applied to the gaseous fuel, in the main pipes 102. This allows the start and the setting up to full rate of the furnace to be made with perfect uniformity throughout the furnace.

It is obvious that the improved furnace according to the invention, as well as the complementary accessories of the plant have been described and illustrated by way of example only and without limitations. Numerous variations and modifications in the construction may therefore be made, as well as further additions and improvements in the system as a whole or to its individual components without departing from the true scope of the present invention.

I claim:

1. An apparatus for firing ceramic tiles by continuously progressively advancing the tiles coated on their upper face with a glaze composition along a horizontal transfer plane through an elongated treatment chamber, comprising an elongated thermally insulated tunnel-like structure defining said treatment chamber having a side wall on each side, a succession of rollers aligned with their axes on a horizontal plane and perpendicular to the longitudinal axis of said treatment chamber for supporting and advancing the tiles thereon, support means supporting said rollers adjacent their ends in said side walls and permitting their axial movement, an annular toothed driven member detachably secured to at least one end of said rollers and located outside of said structure, and a toothed drive member disposed along the common side of said rollers and engaged with said tooth driven member to rotate said rollers, said driven member being individually disengageable from said rollers to allow each roller to be individually removed or introduced by motion parallel to its axis.

2. An apparatus according to claim 1, comprising gas burners arranged in the sidewalls of the tunnel-like structure in longitudinally staggered relationship and in staggered positioned relationship above and below the rollers, the innermost end of said burners extending to a plane not protruding from the inner surface of the sidewall in which the burner is arranged.

3. An apparatus according to claim 2, wherein each of said burners comprises two concentric tubes the larger of which being inserted in a sidewall of the tunnel-like structure, the smaller tube being connected to a supply of fuel gas and the gap between the two tubes being connected to a supply of air, and further comprises an air distribution member comprising a plate-like portion extending perpendicular to the axes of the tubes and in the gap therebetween and a sleeve-like portion parallel to the tubes extending between the tubes and beyond said plate-like portion towards the inner surface of side wall to a point beyond the end of said smaller tube but not as far as the end of said larger tube, apertures being provided in said plate-like portion for allowing inlet of air into the gap between said sleeve-like portion and said smaller tube and into the gap between said sleeve-like portion and said larger tube.

4. An apparatus according to claim 1, wherein each roller is driven from one side only, said support means comprising a rotatable bearing element for rotatably supporting said roller at one end the opposite end containing said driven member.

5. An apparatus according to claim 1, wherein said support means comprises substantially gas tight support elements interposed between said side walls and said rollers to prevent the passage of gases therebetween.

6. An apparatus according to claim 1, including means for drawing the gases flowing within said treatment chamber toward the inlet end of said chamber, and vertical partitions extending within said chamber parallel to said rollers and providing local chamber cross-sectional restrictions to deviate the flowing gases toward said rollers.

7. An apparatus according to claim 6, including a final tile cooling section and means for feeding air to said section.

8. An apparatus according to claim 6, comprising inspection ports located in the sidewalls of the tunnel-like structure.

9. A ceramic material treatment apparatus comprising at least one firing tunnel unit, a roller conveyor extending centrally through said tunnel unit and including a plurality of cylindrical rollers each having one end rotatably supported in one sude of said tunnel unit and an opposite end extending through the opposite side of said unit and having a roller length extending laterally outside of said tunnel unit, said rollers being axially movable in said associated sides of said tunnerl unit, sealing means sealing said rollers in said tunnerl unit and permitting the rotation thereof, a sleeve removably affixed to said roller length exteriorly of said tunnel unit for positive rotation of said roller with said sleeve, drive sprocket means affixed to each of said sleeves, a drive member connected to each drive spricket means to positively drive and rotate each said sleeve together with each said roller and guide roller means in said tunnel adjacent at least one of said walls providing rotational support for said rollers, a support bar extending along said tunnel unit beneath said drive sprocket means, said drive sprocket means comprising a sprocket affixed to said sleeve, said drive member comprising a chain engaged with each of said sprockets and supported on said bar.

10. A ceramic material treatment apparatus according to claim 9, including means for circulating combustion gases through said tunnel in a direction opposite to the travel direction of the material on said rollers, and baffle means intermittent the length of said tunnel unit for deflecting gases from above the rollers downwardly through the rollers and below them to cause a boiling of the gases which are circulated therethrough, and burner means extending through a wall of said tunnel above and below said rollers for applying additional heating gases in said unit.

11. A ceramic material treatment apparatus according to claim 10, wherein said tunnel unit includes a wall having a burner opening, said burner means including a port stopper disposed in said opening and comprising an outer tubular part arranged around said opening, an inner tubular part supported within said outer tubular part, a diaphragm extending across said inner tubular part, an inner cylinder arranged within said inner tubular part and extending inwardly from said diaphragm, a gas pipe connection for supplying gas connected centrally into said diaphragm spaced inwardly from said inner cylinder and being shorter than said inner cylinder, said diaphragm having a plurality of circumferentially spaced openings communicating in the space between said gas burner and said inner cylinder and from said inner cylinder and said outer tubular portion.

* * * * *